US010661864B2

(12) United States Patent
Warll

(10) Patent No.: US 10,661,864 B2
(45) Date of Patent: May 26, 2020

(54) PROTECTIVE WATERCRAFT BOARD CONTAINER

(71) Applicant: Stephen Kenneth Warll, Pine Brook, NJ (US)

(72) Inventor: Stephen Kenneth Warll, Pine Brook, NJ (US)

( * ) Notice: Subject to any disclaimer, the term of this patent is extended or adjusted under 35 U.S.C. 154(b) by 15 days.

(21) Appl. No.: 15/673,779

(22) Filed: Aug. 10, 2017

(65) Prior Publication Data

US 2018/0050770 A1 Feb. 22, 2018

Related U.S. Application Data

(60) Provisional application No. 62/376,697, filed on Aug. 18, 2016.

(51) Int. Cl.

| | |
|---|---|
| ***B65D 81/02*** | (2006.01) |
| ***B63B 35/85*** | (2006.01) |
| ***B63B 35/79*** | (2006.01) |

(52) U.S. Cl.

CPC ..... *B63B 35/85* (2013.01); *B63B 35/7946* (2013.01); *B65D 81/022* (2013.01)

(58) Field of Classification Search

CPC ... B63B 35/7946; B63B 35/85; B65D 81/022; B65D 81/02; B65D 81/051; B63C 13/00

USPC ..... 206/315.1

See application file for complete search history.

(56) References Cited

U.S. PATENT DOCUMENTS

| | | | | |
|---|---|---|---|---|
| 3,339,607 | A * | 9/1967 | Howard | B63B 35/7946 114/79 R |
| 4,030,600 | A * | 6/1977 | Heaps | B65D 19/20 206/597 |
| 4,157,754 | A * | 6/1979 | Bartsch | B65D 85/07 206/83.5 |
| 4,483,380 | A * | 11/1984 | Beran | A45C 3/00 206/315.1 |
| 4,719,952 | A * | 1/1988 | Geronimo | B63B 35/7933 114/219 |
| 5,033,497 | A * | 7/1991 | Hernandez | B63B 35/7946 135/116 |

(Continued)

OTHER PUBLICATIONS

Notification of Transmittal of the International Search Report and the Written Opinion of the International Searching Authority, or the Declaration for PCT/US2017/047401, dated Oct. 25, 2017, 14 pages.

*Primary Examiner* — Steven A. Reynolds
(74) *Attorney, Agent, or Firm* — Lowenstein Sandler LLP

(57) ABSTRACT

A container or pod for securely housing a watercraft (e.g., a surfboard) is described. A board pod assembly is configured to enclose or encompass a surfboard using components composed of sustainable recyclable materials that can be reused or recycled. The board pod assembly may include a corrugated paper-based frame shaped and sized to receive the board within an inner cavity formed by the frame. The frame may be configurable between a ring-shaped configuration (e.g., for use in enclosing the board) and a folded configuration (e.g., for storage purposes when not enclosing the board). The board pod assembly includes a bottom lid configured to couple to a surface of the frame. The assembly further includes a top lid configured to couple to a surface of frame (e.g., an upper surface of the frame) opposing the surface to which the bottom lid is attached.

14 Claims, 6 Drawing Sheets

(56) References Cited

U.S. PATENT DOCUMENTS 5,094,344 A * 3/1992 Savage ..... B63B 35/7946 206/315.1
5,405,002 A * 4/1995 Troia ..... A45F 3/15 206/315.1
5,732,531 A * 3/1998 de Silva ..... B65D 85/07 53/416
5,967,314 A * 10/1999 McGovern ..... A63C 11/027 150/154
6,003,745 A * 12/1999 Mechanic ..... A45C 9/00 206/315.1
6,199,700 B1 3/2001 Yamamoto et al.
7,780,355 B2 * 8/2010 Malloy ..... B63B 35/7946 206/315.1
8,191,712 B2 * 6/2012 Koett ..... B65D 81/113 206/315.1
8,250,835 B2 * 8/2012 Kenneally ..... B65D 19/38 150/154
8,387,789 B2 * 3/2013 Baker ..... B63B 35/7946 206/315.1
2002/0104725 A1 * 8/2002 Dexheimer ..... A45C 5/14 190/108
2005/0023177 A1 * 2/2005 Kiger ..... B63B 35/7946 206/522
2006/0289584 A1 * 12/2006 Lu ..... A45C 7/009 224/605
2007/0125671 A1 * 6/2007 Stephens ..... B65D 5/0005 206/315.1
2009/0283436 A1 * 11/2009 Carcamo ..... B63B 35/7946 206/522
2010/0006469 A1 * 1/2010 Allouche ..... B63B 35/7946 206/523
2012/0118766 A1 * 5/2012 Baker ..... B63B 35/7946 206/315.1
2012/0118767 A1 5/2012 Koett et al.
2013/0043152 A1 * 2/2013 Muroki ..... B63B 35/7946 206/315.1
2015/0197320 A1 7/2015 Ventura
2015/0216277 A1 8/2015 Boyles
2016/0083055 A1 * 3/2016 Coleman ..... B63B 35/7946 206/315.1

* cited by examiner

PROTECTIVE WATERCRAFT BOARD CONTAINER

CROSS-REFERENCE TO RELATED APPLICATION

This application claims the benefit of U.S. Provisional Patent Application No. 62/376,697, filed Aug. 18, 2016, titled "Protective Watercraft Board Pod", the entirety of which is hereby incorporated by reference herein.

TECHNICAL FIELD

The present disclosure relates to a protective packing container, case, or pod for a watercraft board, such as, for example, a surfboard, paddleboard, bodyboard or surfcraft.

BACKGROUND

Packing and protecting boards is critical during shipment, travel and storage to prevent damage. Boards can use padded bags for storage and travel. In cases that involve airline travel, it is critical to pad boards with extra foam, bubble wrap or other protective materials. Similarly when boards are shipped they are normally padded and packed in a corrugated paper container. However, conventional padded bags, with or without the extra packing materials, fail to adequately protection during transportation, leading to damage to the surfboard.

BRIEF DESCRIPTION OF THE DRAWINGS

The present disclosure will be understood more fully from the detailed description given below and from the accompanying drawings of various embodiments of the present disclosure, which, however, should not be taken to limit the present disclosure to the specific embodiments, but are for explanation and understanding only. Further, it should be understood that the drawings are not necessarily proportional or to scale.

DETAILED DESCRIPTION

Figure 1A:
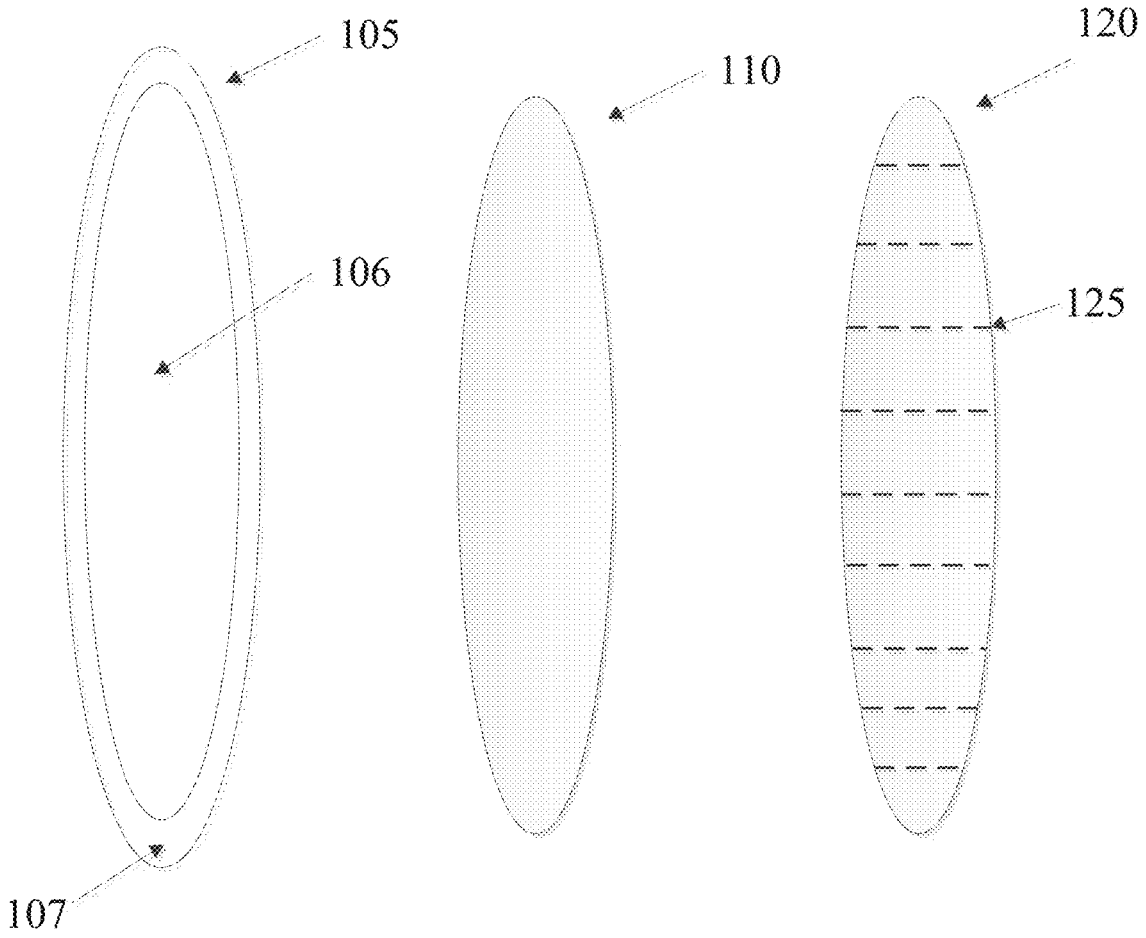
FIG. 1A illustrates a top a view of a frame, a top lid, and a bottom lid of a board pod assembly, according to one or more embodiments.

The present disclosure is directed to a sustainable alternative to packing surfboards, wakeboards, snowboards paddleboards and similar sports recreation devices (herein collectively referred to as "boards" or "watercraft boards"). In one embodiment, an apparatus or board pod assembly is configured to enclose or encompass the board using components composed of sustainable recyclable materials that can be reused or recycled. In one embodiment, the board pod assembly (also referred to as an "assembly") includes a corrugated paper-based frame. In one embodiment, the frame is shaped and sized to receive an object (e.g., a board) within an inner cavity formed by the frame. In one embodiment, the frame is configurable between a ring-shaped configuration (e.g., for use in enclosing the board) and a folded configuration (e.g., for storage purposes when not enclosing the board). The frame may be constructed using any suitable materials. In one embodiment, the frame is composed of a paper-based material, a plastic-based material, a corrugated paper-based material, a corrugated plastic-based material, or a suitable combination thereof.

In one embodiment, the frame may be fabricated using the remaining scrap materials generated when fabricating a board composed of a same material as the frame. For example, in cases that the boards are made from similar materials as the frame, the scrap from the board design can be utilized to create the frame, offering further reduction of waste and sustainability.

In one embodiment, the assembly includes a bottom lid configured to couple to a surface of the corrugated paper-based frame. The bottom lid may be composed of any suitable material, such as a lightweight material that is water resistant. In one embodiment, the bottom lid may be composed of a paper-based material, a plastic-based material, a corrugated paper-based material, a corrugated plastic-based material, or a suitable combination thereof.

In one embodiment, the assembly includes a top lid configured to couple to a surface of frame. In one embodiment, the top lid is configured to couple to a surface of the frame (e.g., an upper surface of the frame) opposing the surface to which the bottom lid is attached. In one embodiment, when the bottom lid is attached to a first surface of the frame (e.g., a bottom surface) and the top lid is attached to a second surface of the frame (e.g., a top surface), the inner cavity of the frame is surrounded to form a protective enclosure for the object to be stored (e.g., the board). In one embodiment, a first surface of the bottom lid, a first surface of the top lid, and the interior surface of the frame in the ring-shaped configuration form an enclosure that is dimensioned and shaped to secure enclose the board within the inner cavity.

In one embodiment, the top lid may be composed of any suitable material, such as a lightweight material that is water resistant. In one embodiment, the top lid may be composed of a paper-based material, a plastic-based material, a corrugated paper-based material, a corrugated plastic-based material, or a suitable combination thereof.

In one embodiment, one or more connector components may be used to attach at least one of the bottom lid or the top lid to the frame. For example, the connector components may include any suitable connector, such as, a dowel pin, a male-to-female connector pair, a hook and loop arrangement (e.g., Velcro®), a strap arrangement, etc.

In one embodiment, a first surface of the bottom lid, a first surface of the top lid, and the interior surface of the frame in the ring-shaped configuration form an enclosure that is dimensioned and shaped to secure enclose the board within the inner cavity. In this regard, the assembly forms a nest sized and shaped for a board to sit within. In one embodiment, 360 degree protection is provided to the enclosed board using a sustainable material that can be reused or recycled. Advantageously, the assembly, according to embodiments of the present disclosure, eliminates the need for tape, bubble wrap or other disposable packing materials, such as those used with conventional board bags. According to another benefit, the assembly may be used for transporting a board in a safe enclosure configured to protect the board against bumps, drops, etc.

In one embodiment, one or more of the frame, the top lid, or the bottom lid may be composed of corrugated material (e.g., paper or plastic) including an arrangement of flutes. According to embodiments, any suitable arrangement, configuration, designation, or size of flutes may be employed (e.g., an "A" flute designation, a "B" flute designation, a "C" flute designation, a "D" flute designation, an "E" flute designation, an "F" flute designation, etc.) In one embodiment, one or more of the frame, the top lid, or the bottom lid may be composed of corrugated material in a honeycomb configuration.

In one embodiment, the frame may include multiple foldable sections. In one embodiment, the frame may be transitioned between a ring-shaped configuration and a folded configuration by folding the frame at one or more foldable sections. In one embodiment, a series of foldable sections may be positioned or spaced apart along the length of the frame to enable the frame to be folded for storage purposes. In one embodiment, the multiple foldable sections may include alternating up-fold and down-fold sections. In one embodiment, foldable sections may be positioned on both sides of the ring-shaped frame at or near a middle point. In one embodiment, the foldable sections at or near the middle of the ring-shaped frame may be a larger size than the other foldable sections of the frame.

In one embodiment, one or both of the top lid or the bottom lid may include multiple scored sections to enable folding of the lid. In one embodiment, a scored section is a portion of the lid that is scored to include one or more score lines to allow bending or folding along the score line. In one embodiment, the scored sections may be alternately disposed on opposing sides of the lid to enable the lid to be folded in an accordion-like manner. In one embodiment, in the folded configuration, each of the top lid and the bottom lid are smaller in size than when in the unfolded (or flat) configuration. Advantageously, the folded lids may be stacked with the folded frame for storage purposes.

FIG. 1A illustrates example components of a board pod assembly, according to embodiments of the present disclosure. In one embodiment, the board pod assembly includes a frame 105, a bottom lid 110, and a top lid 120. As shown in FIG. 1A, the frame 105 may be configured in a ring-shaped configuration forming an inner cavity 106 (e.g., the space within the frame 105). In one embodiment, the frame 105 is sized and shaped to create an inner cavity 106 to accept and receive a similarly sized and shaped object, such as a board.

In one embodiment, the frame 105 includes a top surface 107 and a bottom surface 108 (shown in FIG. 1B) configured to couple to the top lid 120 and the bottom lid 110, respectively. In one embodiment, one or more of the top surface 107 and the bottom surface 108 may include connector components (not shown) configured to attach the frame 105, the top lid 120, and the bottom lid 110 in an assembled configuration such that a board (or other object) is enclosed within the inner cavity 106.

Figure 1B:
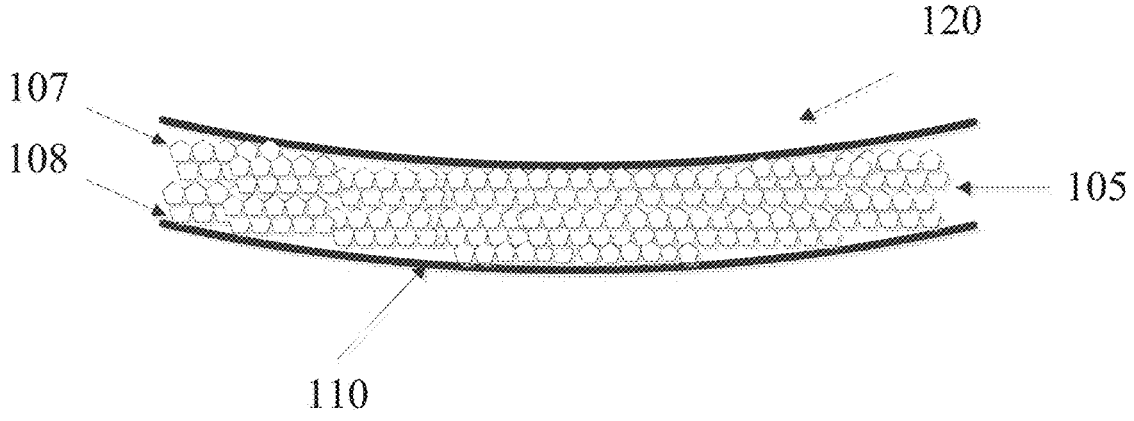
FIG. 1B illustrates a side view of at least a portion of a board pod assembly, according to one or more embodiments.

FIG. 1B illustrates a side view of an example portion of a board pod assembly including a top surface 107 of the frame 105 coupled to a top lid 120 and a bottom surface 108 of the frame 105 coupled to a bottom lid 110. In one embodiment, as shown in FIG. 1B, the frame 105 may be composed of a corrugated paper-based or plastic-based material. In one embodiment, the corrugated paper-based or plastic-based frame 105 may include one or more flutes arranged in a honeycomb configuration.

In one embodiment, as shown in FIG. 1A, the top lid 120 may include one or more foldable portions 125. In one embodiment, the foldable portion 125 of the lid (either or both of the bottom lid 110 and the top lid 120) include an area, piece, or portion of the lid that enables folding. In one example, the foldable portion 125 may include a scored portion of the lid that extends horizontally across the lid (i.e., relative to an axis extending longitudinally from one nose or end of the lid to the other nose or end of the lid). In one embodiment, the foldable section 125 includes scoring or score lines extending horizontally across the lid to enable lid 120 to be folded along the score lines, as described in greater detail below. It is to be appreciated that although FIG. 1A shows the top lid 120 including the foldable portions, both the bottom lid 110 may include one or more foldable sections. In one embodiment, neither the bottom lid 110 nor the top lid 120 may include the foldable portions 125.

Figure 2A:
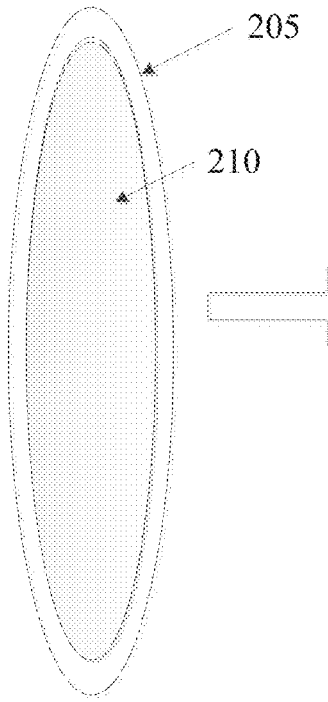
FIGS. 2A-2C illustrate stages of assembly of an example board pod, according to one or more embodiments.
Figure 2B:
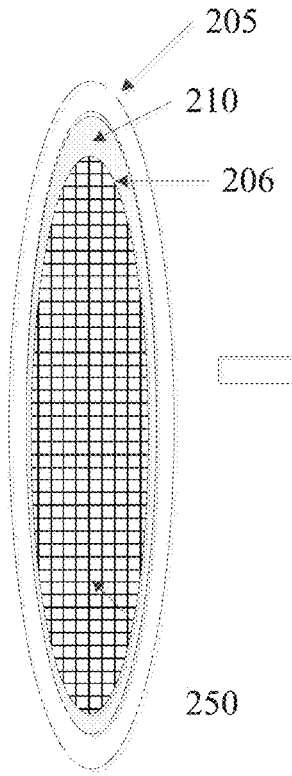
Figure 2C:
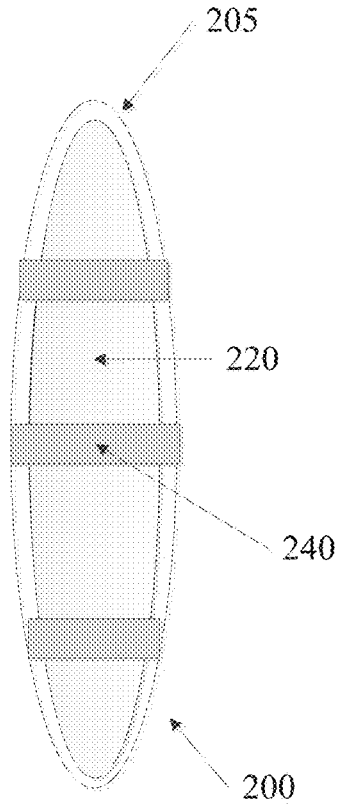

FIGS. 2A-2C illustrate various stages of assembly of a board pod assembly, according to embodiments of the present disclosure. As shown in the top view of FIG. 2A, a frame 205 is coupled with a bottom lid 210. In one embodiment, the bottom lid 210 is attached or coupled to a bottom surface (not shown) of the frame 205. In one embodiment, the bottom lid 210 is coupled to the frame 205 using one or more connector components (e.g., dowel pins, a hook and fastener arrangement, an adhesive, etc.).

In a next stage, as shown in the top view of FIG. 2B, an object 250 is placed on a top surface (i.e., the surface facing upwards) of the bottom lid 210. For the purposes of illustrate, the object 250 (e.g., a surfboard) is shown in FIG. 2B as having hatching lines. In one embodiment, the object 250 to be stored is positioned within the inner cavity 206 such that the object 250 rests on the top surface of the bottom lid 210 and is supported along a perimeter by the frame 205.

In a next stage, as shown in in the top view of FIG. 2C, a top lid 220 is place on top of the object 250. In one embodiment, the top lid 220 is in contact with at least a portion of a top surface of the frame 205. In one embodiment, the top lid 220 may be sized and shaped to fit within the inner cavity 206 of the frame 205. In an embodiment, one or more straps 240 may be used to hold the top lid 220, the frame 205 and the bottom lid 210 into an assembled unit. As shown in FIG. 2C, the board pod assembly 200 securely holds the object 250 within the inner cavity 206 formed by the frame 205, the bottom lid 210 and the top lid 220.

Figure 2D:
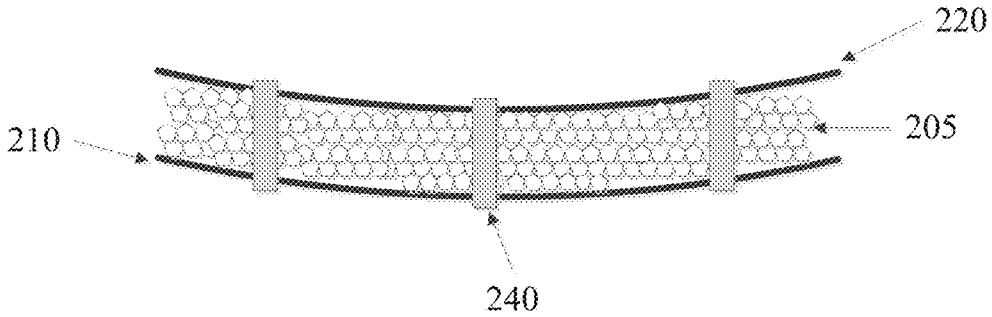
FIG. 2D illustrates a side view of an example board pod assembly, according to one or more embodiments.

FIG. 2D depicts a side view of a portion of the assembled board pod including a frame 205, a bottom lid 210, and a top lid 220 arranged in a pod assembly to enclose an object 250. As shown in FIG. 2D, multiple straps or bands 240 are employed to secure the board pod assembly in the assembled configuration.

Figure 3A:
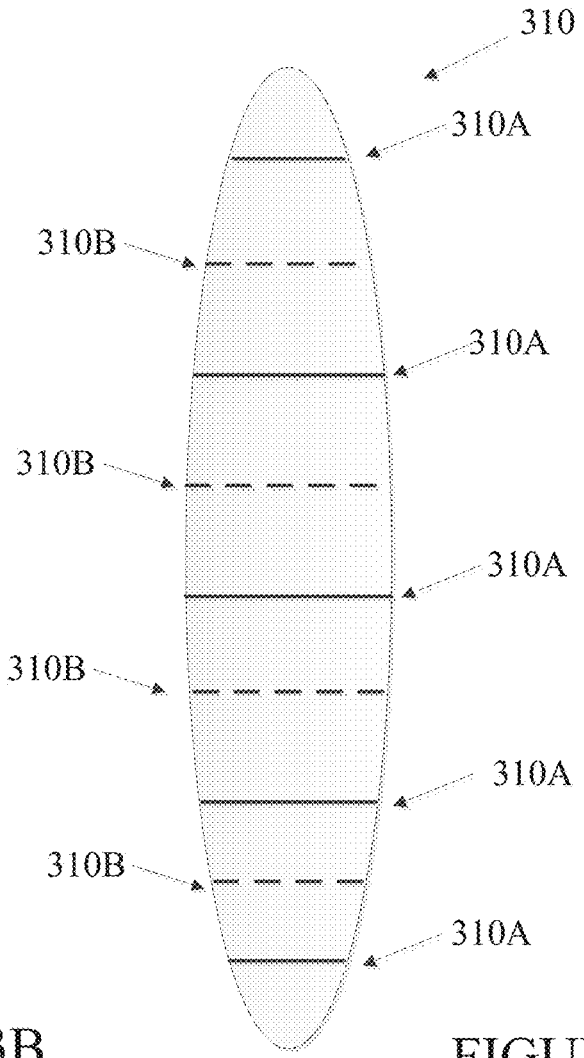
FIGS. 3A-3C illustrate various views of an example lid of a board pod assembly, according to one or more embodiments.
Figure 3B:
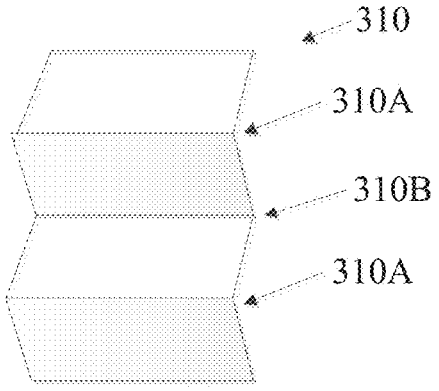
Figure 3C:
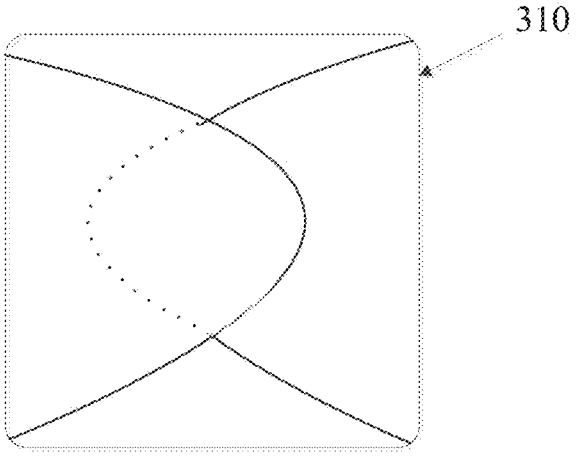

FIG. 3A illustrates an example lid 310 (i.e., either a top lid or a bottom lid) including multiple foldable portions 310A, 310B. In one embodiment, the foldable portions including alternating up-fold 310A and down-fold 310B portions. In this example, folding at an up-fold portion 310A causes a natural fold in an upward manner and folding at a down-fold portion 310B causes a fold in an opposite direction (i.e., a downward direction). As shown in FIG. 3B, the alternating arrangement of the up-fold portions 310A and the down-fold portions 310B enable the lid 310 to be folded in an accordion-like manner. In one embodiment, a first foldable portion (e.g., an up-fold portion 310A) may include scoring on a top surface of the lid 310 and a second foldable portion (e.g., a down-fold portion 310A) may include scoring an opposing side surface (e.g., a bottom surface) of the lid 310. As shown in the example of FIG. 3C, the lid 310 may be folded into a folded configuration, representing a smaller size and footprint as compared to the flat configuration. In one embodiment, the folded configuration of the lid 310 shown in FIG. 3C may be used to store the lid 310, when not in use in the board pod assembly.

Figure 4:
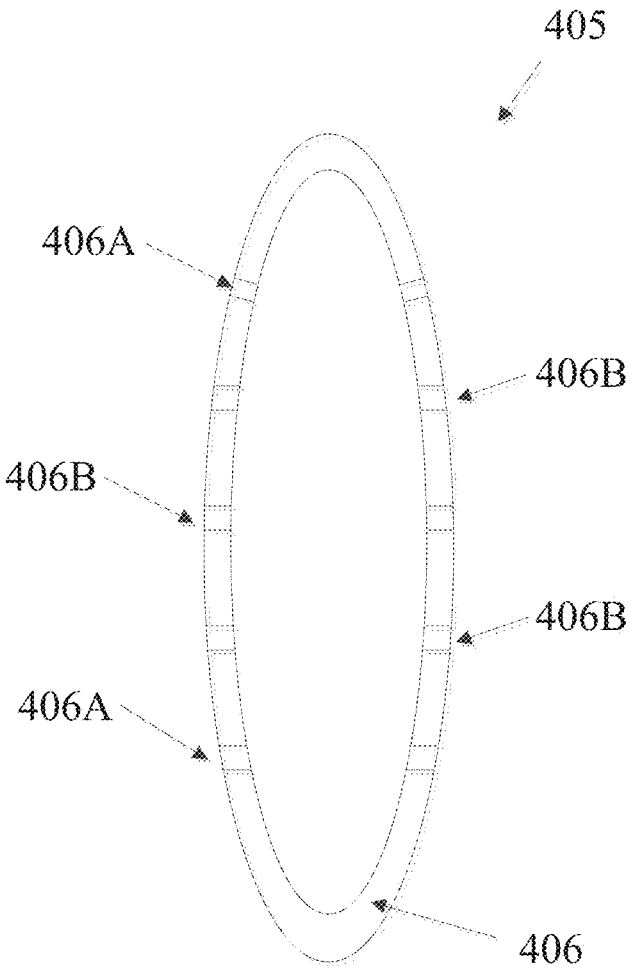
FIG. 4 illustrates an example frame of a board pod assembly, according to one or more embodiments.

FIG. 4 illustrates an example frame 405 including one or more foldable portions 406A, 406B. In one embodiment, the frame 405 may include alternately arranged up-fold portions 406A and down-fold portions 406B. In one embodiment, the foldable portions 406 may be spaced apart along the frame 405 to enable the frame 205 to be transitioned from a ring-shaped configuration (as shown in FIG. 4) to a folded configuration. In one embodiment, the frame 405 may include multiple layers (or multiple frame structures) that can be stacked to form the inner cavity when in in the ring-shaped configuration. In one embodiment, the one or more frames 405 may be folded using the foldable sections 406A, 406B to fold or collapse into a smaller profile for storing with the top lid and bottom lid. In one embodiment, the one or more straps may be used to couple the frame 405, top lid, and bottom lid when in the folded configuration.

Figure 5A:
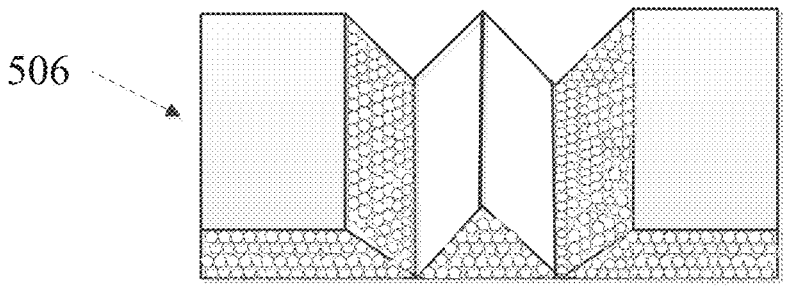
FIGS. 5A and 5B depict a portion of a frame of a board pod assembly, according to one or more embodiments.
Figure 5B:
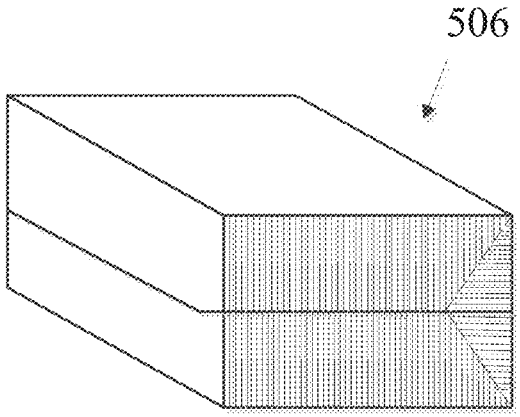

FIG. 5A illustrates an example portion of a foldable section 506 of a frame. As shown, the foldable portion 506 may be configured (e.g., cut and shaped) to enable folding to form a folded configuration, as shown in FIG. 5B. In one embodiment, a foldable portion 506, such as the one shown in FIG. 5A, may be arranged on a top surface of a frame. In one embodiment, a foldable portion 506 with an opposing orientation may be disposed on a bottom surface of the frame, in an alternating manner, to enable the frame to be folded in a compact manner.

Figure 6:
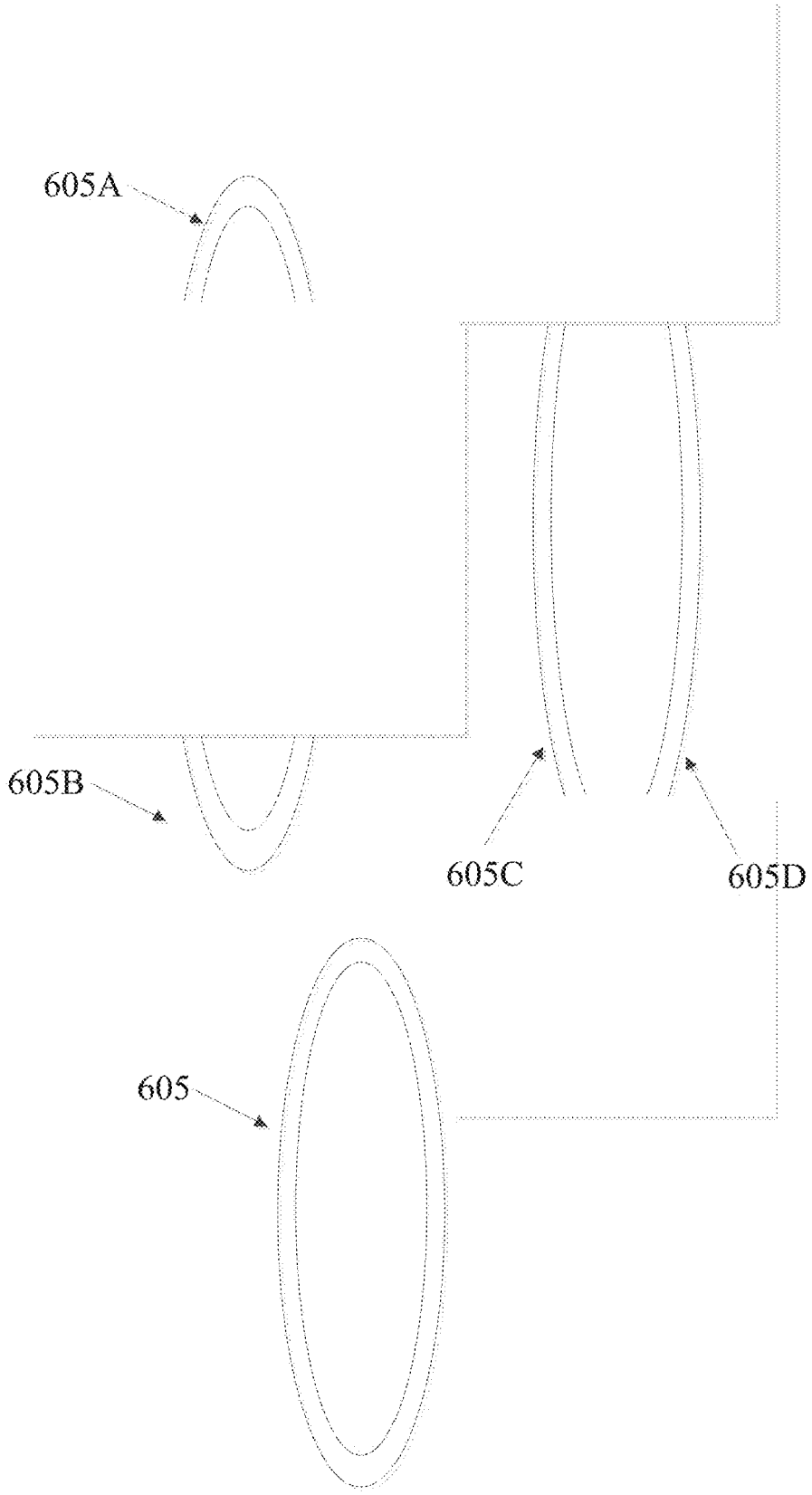
FIG. 6 illustrates an example frame of a board pod assembly, according to one or more embodiments

FIG. 6 illustrates an embodiment of a frame 605 including multiple segments 605A, 605B, 605C, and 605D. As shown, the frame 605 may include segments 605A-605D configured to couple or connect to one another to form the frame 605 in the ring-shaped configuration. In one embodiment, the multiple segments 605A-605D may be disassembled to transition the frame 605 to the folded configuration, for storage purposes.

In one embodiment, an example board pod assembly may be comprised of comprised of recycled paper products that are recyclable, sustainable, and renewable and can be taken from scrap materials of a specific board-making process. The board pod assembly may also be reused, thereby eliminating a need for additional perishable packing materials, such as tape, bubble wrap and foam. Advantageously, a board pod assembly according to embodiments of the present disclosure can be used to transport an object (e.g., a surfboard), travel with the object, store the object, and protect the object. In one embodiment, scrap material produced as a by-product of a board manufacturing process may be used to form the frame of the board pod assembly.

According to implementations of the present disclosure, a board pod assembly may be configured to include a honeycomb paper perimeter that can, for example, be the scrap cut out of the core of a honeycomb core surfboard. In this embodiment, a perimeter of the frame is naturally sized and shaped to the particular shape of the specific board from which it was derived. In one embodiment, the frame includes a corrugated honeycomb paper perimeter that may be hand or machine cut (e.g., die cut, laser cut, waterjet cut, router cut, etc.).

A pod according to the present disclosure uses a corrugated paper top sheet and a corrugated paper bottom sheet that ideally is double wall corrugated, falcon board or layered honeycomb. The top and bottom sheets also can be scrap from the frame cut out of a paper based surfboard core. When the board is nested in the honeycomb and between the corrugated top and bottom layer, it creates a natural protective pod for the surfboard. Additional internal padding can be provided in many forms if needed, such as, for example, biodegradable green foam. The pod may be held together by adjustable reusable Velcro straps or rubber bands which eliminate the need for glue or tape. Furthermore, the straps may allow for rapid packing and unpacking of the board with no portion of the board exposed to an outside environment. In one embodiment, the honeycomb paper and the corrugated paper offer natural protection against the elements. The materials are lightweight, making them ideal for the specific use. The paper materials are reusable, recyclable, compostable and biodegradable creating extremely low environmental impact in any scenario. In the case that a board does not have a detachable fin system, the fins can be left exposed and prone to damage.

In one embodiment, the board pod assembly may include a protective fin brick to protect one or more exposed fins or projections of a surfboard. In one embodiment, the protective fin brick may be composed of a paper-based material having a honeycomb configuration. In an implementation, the one or more fin bricks may have slot cut outs through at least one surface that match a pattern of the corresponding fin of the surfboard. In one embodiment, a paper-based brick is configured to attach to the fins by a slight compression fit of the paper-based brick voids (e.g., a honeycomb paper arrangement) that match or correspond to the surfboard fins. In one embodiment, the one or more bricks naturally hold to the fins without additional tape or adhesive. In one embodiment, the fin brick provides protection to the one or more surfboard fins and may be snapped on and pulled off in seconds. In one embodiment, the fin brick is composed of reusable and recyclable materials (e.g., paper or plastic). In one embodiment, the adjustable straps can be configured to strap over the fin brick to provide an additional holding force.

In one embodiment, in the assembled configuration, the board pod encloses a surfboard for transport. In one embodiment, the board pod may be transitioned to a folded configuration for transport inside a travel bag. Advantageously, the board pod may be assembled quickly and offers protection from an outside environment. In one embodiment, the board pod includes a corrugated paper top lid and bottom lid and a honeycomb paper-based frame or perimeter. In one embodiment, the board pod includes one or more reusable and adjustable adhesive straps (e.g., Velcro® straps) to eliminate or reduce the need for tape. In one embodiment, the board pod includes environmentally friendly biodegradable foam that may be added internally for additional protection. In one embodiment, the board pod is composed of a flexible corrugated material (e.g., paper or plastic) and conforms to the rocker of a surfboard when in the assembled configuration.

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. An apparatus comprising:

a corrugated paper-based ring-shaped frame configured to completely surround a perimeter of an object within an inner cavity of the corrugated paper-based frame;

a corrugated paper-based bottom lid configured to removably couple to a bottom surface of the corrugated paper-based frame; and a corrugated paper-based top lid comprising a plurality of folds to enable folding of the corrugated paper-based top lid into a folded configuration, the corrugated paper-based top lid configured to removably couple to an upper surface of the corrugated paper-based frame, wherein the object is nested and securely held in the corrugated paper-based ring-shaped frame and surrounded by the corrugated paper-based top lid and the corrugated paper-based bottom lid, and wherein the corrugated paper-based bottom lid and the corrugated paper-based top lid are foldable upon complete decoupling from the corrugated paper-based frame.

2. The apparatus of claim 1, wherein the object is a watercraft board.

3. The apparatus of claim 1, wherein the corrugated paper-based bottom lid is removably coupled to the corrugated paper-based frame using one or more connector components.

4. The apparatus of claim 1, further comprising:

one or more straps configured to removably couple the corrugated paper-based top lid with the corrugated paper-based frame and the corrugated paper-based bottom lid.

5. The apparatus of claim 1, wherein the corrugated paper-based frame comprises a plurality of flutes arranged in a honeycomb configuration.

6. An apparatus comprising:

a ring-shaped frame configured to form an inner cavity shaped to completely surround a perimeter of a surfboard;

a plastic-based bottom lid configured to removably couple to a bottom surface of the frame; and a plastic-based top lid comprising:

at least one first horizontal score extending across a top surface of the plastic-based top lid; and at least one second horizontal score extending across a bottom surface of the top lid, wherein the top lid is foldable along the at least one first horizontal score and the at least one second horizontal score to position the top lid into a folded configuration, wherein the plastic-based top lid is configured to removably couple to an upper surface of the frame, wherein the surfboard is nested and securely held in a paper-based portion of the ring-shaped frame and surrounded by the plastic-based top lid and the plastic-based bottom lid, and wherein the plastic-based bottom lid and the plastic-based top lid are foldable upon complete decoupling from the frame.

7. The apparatus of claim 6, wherein the paper-based portion of the ring-shaped frame comprises a plurality of corrugated flutes.

8. An apparatus comprising:

a corrugated paper-based ring-shaped frame configured to completely surround a perimeter of an object within an inner cavity of the corrugated paper-based frame;

a corrugated paper-based bottom lid configured to removably couple to a bottom surface of the corrugated paper-based frame; and a corrugated paper-based top lid comprising:

at least one first horizontal score extending across a top surface of the corrugated-based top lid; and at least one second horizontal score extending across a bottom surface of the corrugated-based top lid, wherein the corrugated-based top lid is foldable along the at least one first horizontal score and the at least one second horizontal score to position the corrugated-based top lid into a folded configuration, wherein the corrugated paper-based top lid is configured to removably couple to an upper surface of the corrugated paper-based frame, wherein the object is nested and securely held in the corrugated paper-based ring-shaped frame and surrounded by the corrugated paper-based top lid and the corrugated paper-based bottom lid, and wherein the corrugated paper-based bottom lid and the corrugated paper-based top lid are foldable upon complete decoupling from the corrugated paper-based frame.

9. The apparatus of claim 8, wherein the object is a watercraft board.

10. The apparatus of claim 8, wherein the corrugated paper-based bottom lid is removably coupled to the corrugated paper-based frame using one or more connector components.

11. The apparatus of claim 8, further comprising:

one or more straps configured to removably couple the corrugated paper-based top lid with the corrugated paper-based frame and the corrugated paper-based bottom lid.

12. The apparatus of claim 8, wherein the corrugated paper-based frame comprises a plurality of flutes arranged in a honeycomb configuration.

13. An apparatus comprising:

a ring-shaped frame configured to form an inner cavity shaped to completely surround a perimeter of a surfboard;

a plastic-based bottom lid configured to removably couple to a bottom surface of the frame; and a plastic-based top lid comprising a plurality of folds to enable folding of the plastic-based top lid into a folded configuration, wherein the plastic-based top lid is configured to removably couple to an upper surface of the frame, wherein the surfboard is nested and securely held in a paper-based portion of the ring-shaped frame and surrounded by the plastic-based top lid and the plastic-based bottom lid, and wherein the plastic-based bottom lid and the plastic-based top lid are foldable upon complete decoupling from the frame.

14. The apparatus of claim 13, wherein the plastic-based portion top lid comprises a plurality of flutes.

* * * * *